US007183241B2

(12) United States Patent
Cartwright

(10) Patent No.: US 7,183,241 B2
(45) Date of Patent: Feb. 27, 2007

(54) LONG LIFE LUBRICATING OIL COMPOSITION WITH VERY LOW PHOSPHORUS CONTENT

(75) Inventor: Stanley James Cartwright, Sarnia (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 390 days.

(21) Appl. No.: 10/666,356

(22) Filed: Sep. 19, 2003

(65) Prior Publication Data

US 2005/0026792 A1 Feb. 3, 2005

Related U.S. Application Data

(60) Provisional application No. 60/418,606, filed on Oct. 15, 2002.

(51) Int. Cl.
*C10M 169/04* (2006.01)
*C10M 141/12* (2006.01)

(52) U.S. Cl. ..... 508/363; 508/364; 508/365; 508/371; 508/372; 508/373; 508/374; 508/375; 508/376; 508/378; 508/443; 508/444

(58) Field of Classification Search ..... None
See application file for complete search history.

(56) References Cited

U.S. PATENT DOCUMENTS

| | | | | | |
|---|---|---|---|---|---|
| 5,569,405 | A * | 10/1996 | Nakazato et al. | ..... | 508/192 |
| 5,693,598 | A * | 12/1997 | Abraham et al. | ..... | 508/444 |
| 5,726,133 | A * | 3/1998 | Blahey et al. | ..... | 508/390 |
| 5,744,430 | A * | 4/1998 | Inoue et al. | ..... | 508/295 |
| 6,140,282 | A * | 10/2000 | Cartwright et al. | ..... | 508/398 |
| 6,191,081 | B1 * | 2/2001 | Cartwright et al. | ..... | 508/460 |
| 7,112,558 | B2 * | 9/2006 | Gatto | ..... | 508/363 |

* cited by examiner

*Primary Examiner*—Matthew A. Thexton
(74) *Attorney, Agent, or Firm*—Norby Foss; Gary P. Katz

(57) ABSTRACT

A lubricating oil with very low phosphorus content, and having long life as evidenced by a reduction in viscosity increase, oxidation and nitration, comprises a major amount of a base oil of lubricating viscosity and a minor amount of a mixture of neutral and overbased metallic detergents, at least a zinc dialkyldithiocarbamate and a zinc dialkyldithiophosphate antiwear additive and at least a dihydrocarbylthiocarbamoyl.

14 Claims, No Drawings

LONG LIFE LUBRICATING OIL COMPOSITION WITH VERY LOW PHOSPHORUS CONTENT

This application claims the benefit of U.S. Provisional Application No. 60/418,606 filed Oct. 15, 2002.

FIELD OF INVENTION

This invention relates to gas engine oils. More specifically the invention is concerned with extending the life of gas engine oils as evidenced by a reduction in viscosity increase, oxidation and nitration.

BACKGROUND OF INVENTION

Natural gas-fired engines are widely used in the petroleum industry typically to drive compressors that compress natural gas at well heads and along pipelines. In other industries they are often used for in-house electric generators and co-generation systems. In general these gas fired engines are designed to operate at higher temperatures than other internal combustion engines. Additionally these engines are operated near full load conditions for significant time periods, if not continuously. Under these service conditions the life of gas engine lubricants is often limited by oil oxidation and nitration processes. Therefore, gas engine oils are formulated with additives to extend oil life through enhanced resistance to oil oxidation and nitration.

In addition to controlling oxidation and nitration properties of a gas engine oil, it also is necessary to control the ash content of the oil because the ash acts as a solid lubricant protecting, for example, the valve/seat interface of the engine.

The ash level of the lubricant often is determined by its formulation components, with metal-containing detergents and metallic-containing antiwear additives contributing to the ash level of the lubricant. Gas engine manufacturers specify the appropriate lubricant ash level for correct operation of a given engine. Thus, manufacturers of 2-cycle engines often specify use of an ashless oil. Manufacturers of 4-cycle engines may specify low, medium or high ash depending upon the level required for engine cleanliness and durability.

For this reason gas engine oils are classified according to their ash content. The classifications are:

| Ash Designation | Ash Level, wt % (ASTM D874) |
|---|---|
| Ashless | Ash < 0.1% |
| Low Ash | 0.1% < Ash < 0.6% |
| Medium Ash | 0.6% < Ash < 1.5% |
| High Ash | Ash > 1.5% |

A low ash gas engine oil is described, for example, in U.S. Pat. No. 5,726,133 and medium and high ash oils in U.S. Pat. No. 6,191,081.

As is known in the art, additives are used in lubricants to perform numerous functions. For example, some are antioxidants, some are friction modifiers; and some are extreme pressure agents. Indeed some additives perform more than one function. Also as is known in the art, additives will lose their effectiveness if they are improperly combined. Therefore, extreme care must be exercised in combining various additives to assure both compatibility and effectiveness. For example, some friction modifiers affect metal surfaces differently than antiwear agents do. When both are present, friction-reducing and antiwear additives may compete for the surface of the metal parts which are subject to lubrication. This competition can produce a lubricant that is less effective than is suggested by the individual properties of the additive components.

Accordingly, the components of a gas engine lubricant need to be selected to meet the specified ash level and to provide, among other functions, a high level of oxidation and nitration resistance. Whether selected components and their amounts can be balanced to meet desired specification is not a priori predictable.

Many stationary four-cycle gas engines require exhaust catalysts to meet local exhaust emissions limits. Phosphorus emissions the exhaust catalyst material and so manufacturers have placed limits on the fresh oil's phosphorus content. Currently, the strictest limit is 0.03 wt % phosphorus and it is possible that lower phosphorus levels may be legislated in the future. The source of phosphorus in gas engine oils is the ZDDP antioxidant/antiwear additive used in the oil. Reducing ZDDP treats in the oil to lower the phosphorus content is expected to shorten oil life. Therefore, new gas engine oil compositions wit very low phosphorus levels and good antioxidant and antiwear properties are needed.

SUMMARY OF INVENTION

The present invention relates to a lubricating oil composition that at very low phosphorus levels has extended life, as evidenced by reductions in viscosity increase, oxidation and nitration when used at elevated temperatures in gas engines.

The composition comprises:

(a) a major amount of a base oil of lubricating viscosity;

(b) a combination of neutral and overbased metallic detergents in an amount sufficient to provide a sulfated ash in the range of about 0.2 wt % to about 2.0 wt % based on the total weight of the composition;

(c) from about 0.06 vol % to 0.15 vol % of a zinc dialkyldithiophosphate and about 0.1 vol % to 2.0 vol % of a zinc dialkyldithiocarbamate based on the total volume of the composition; and (d) based on the total volume of the composition, from about 0.5 vol % to about 2.0 vol % of an ashless dihydrocarbylthiocarbamoyl antioxidant, or from about 0.5 vol % to about 1.9 vol % of phenolic antioxidants, or from about 0.5 vol % to about 3.0 vol % of mixtures thereof.

Preferably the composition of the invention will include one or more gas engine oil additives including ashless dispersants, ashless antiwear additives, metal passivators, pour point depressants, Viscosity Index (VI) improvers, and antifoamants.

The composition of the invention may be further characterized as having a phosphorus content of up to 0.015 wt %, preferably between about 0.005 to about 0.008 wt %.

Other embodiments of the invention will become apparent from the detailed description which follows.

DETAILED DESCRIPTION OF INVENTION

The composition of the invention includes a major amount of a base oil of lubricating viscosity. Suitable base oils include any natural or synthetic base oil or blends thereof in API categories I, II and II, having a kinematic viscosity at 100° C. of about 5 to about 16 cSt and preferably about 9 to 13 cSt.

The lubricating oil composition of the invention contains a combination of neutral and overbased metallic detergents such as alkali metal and alkaline earth sulfonates, phenates and alkylsalicylates. The preferred metal of the detergents is calcium or barium. Examples of suitable neutral metallic detergents are calcium sulfonates and calcium alkylsalicylates having a Total Base Number (TBN) of from 10 to 100. Examples of overbased metal lie detergents are calcium phenates, sulphonates and alkylsalicylates having a TBN of 150 to 400. The amount of the neutral and overbased metallic detergent is chosen having regard to the desired TBN of the final product and especially having regard to the desired sulfated ash of the final product. Preferably the mixture of neutral and overbased metallic detergents is sufficient to provide the composition with a sulfated ash in the range of about 0.2 wt % to about 2.0 wt %.

The composition also includes a combination of zinc dialkyldithiophosphate and zinc dialkyldithiocarbamate as antiwear agents and oxidation inhibitors. The alkyl group in the zinc compounds typically will be in the range of 3 to 12 carbon atoms. The amount of zinc dialkyldithiophosphate will be in the range of about 0.06 vol % to 0.15 vol % and the amount of zinc dialkyldithiocarbamate will be in the range of about 0.1 vol % to 2.0 vol %, based on the total volume of the composition.

The composition also includes from about 0.5 vol % to about 2.0 vol % an ashless dihydrocarbylthiocarbamoyl antioxidant, or 0.5 vol % to about 1.9 vol % of phenol type antioxidant, or from about 0.5 vol % to about 3.0 vol % of mixtures thereof.

The term "phenol type" used herein includes compounds having one or more than one hydroxy group bound to an aromatic ring which may itself be mononuclear, eg, benzyl, or polynuclear, eg naphthyl and spiro aromatic compounds. Thus, "phenol type" includes phenol per se, catechol, resorcinol, hydroquinone, naphthol, etc., as well as alkyl or alkenyl and sulphurised alkyl or alkenyl derivatives thereof, and bisphenol type compounds including such bi-phenol compounds linked by alkylene bridges or sulphur or oxygen bridges. Alkyl phenols include mono- and poly-alkyl or alkenyl phenols, the alkyl or alkenyl group containing from about 3 to 100 carbons, preferably 4 to 50 carbons and sulphurised derivatives thereof, the number of alkyl or alkenyl groups present in the aromatic ring ranging from 1 up to the available unsatisfied valences of the aromatic ring remaining after counting the number of hydroxyl groups bound to the aromatic ring.

Most preferably the phenol is a hindered phenol such as di-isopropyl phenol, di-t-butyl phenol, di-t-butyl alkylated phenol where the alkyl substituent is hydrocarbyl and contains between 1 and 20 carbon atoms, such as 2,6, di-t-butyl-4-methyl phenol, 2,6 di-t-butyl-4-ethyl phenol. etc., or 2,6 di-t-butyl 4-alkoxy phenol.

Suitable dihydrocarbylthiocarbamoyl compounds are represented by the formula

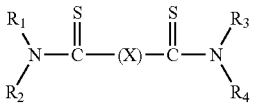

where $R_1$, $R_2$, $R_3$ and $R_4$ are the same or different and each represents an alkyl group of 3 to 30 carbon atoms, X represents S, S—S, S—$(CH_2)_y$—S, S—$CH_2CH_2(CH_3)$—S and y is an integer of 1 to 3.

A fully formulated oil may contain one or more gas engine oil additives including ashless dispersants, ashless antiwear additives, metal passivators, pour point depressants, Viscosity Index (VI) improvers and antifoamants.

The compositions of the invention have a phosphorous content of up to 0.015 wt %, preferably between about 0.005 wt % to about 0.008 wt %.

Experimental

Lab Nitration Screener Test Results

A lab nitration screener test was used to assess the oil life performance of various oil compositions. The test results identify a number of parameters including oil viscosity increase, oxidation, and nitration. All measurements are reported on a relative basis (unless otherwise indicated) so that results greater than unity represent greater levels of degradation. Numerically lower relative results represent a measure of longer oil life. In each test, a Reference Oil is tested and results are reported as a ratio of the result for the test oil divided by the result for the Reference Oil. Thus, if a tested oil has an oxidation result of 1.0, then it has oxidation performance equal to that of the Reference Oil. If the tested oil has an oxidation result less than 1.0, then the tested oil demonstrates oxidation performance superior to that of the Reference Oil.

EXAMPLES

Table 1 provides compositional details of a series of experimental formulations which demonstrate the invention. The Table also sets forth test results used to evaluate the performance of the formulations of the invention and a number of comparative formulations, under nitro-oxidising conditions. The laboratory Nitration Screener Test results are measured relative to Reference Oil 1.

The base oil of the compositions of Table 1 was a 600N American Petroleum Institute (API) Group II basestock. Comparative Oils 1 and 2 use a commercially available gas engine oil additive package, which is one of the most widely sold gas engine oil packages and therefore represents a "benchmark standard" against which other gas engine oil formulations may be measured. Comparative Oil 2 includes a sulfur containing phenolic antioxidant as described in U.S. Pat. No. 5,569,405. Reference Oil 1 represents the improved oil of U.S. Pat. No. 6,140,282. The ZDDP treat in the Reference Oil and the Comparative Oils was about 0.3 vol %, which provides about 300 ppm phosphorus. The ZDDP treat in the invention examples was 0.06 vol %, or about 60 ppm phosphorus.

Reference Oil 1 and Example Oils 1–4 each contained the same mixture of neutral and overbased metallic detergents, ashless dispersant and pour point depressant. All of the oils in Table 1 were formulated to be nominally 0.45 mass % sulphated ash and had substantially the same TBN.

TABLE 1

| | Formulation Description | | | | | | |
|---|---|---|---|---|---|---|---|
| | Comparative Oil 1 | Reference Oil 1 | Invention Example 1 | Invention Example 2 | Invention Example 3 | Invention Example 4 | Comparative Oil 2 (U.S. Pat. No. 5,569,405) |
| | Basestock Description | | | | | | |
| Component (vol %) | Group II basestocks | Group II basestocks | Group II basestocks | Group II basestocks | Group II basestocks | Group II basestocks | Group II basestocks |
| Group II basestock | 87.90 | 90.00 | 89.73 | 89.73 | 89.73 | 89.73 | 87.90 |
| NGEO commercial additive package | 9.60 | — | — | — | — | — | 9.60 |
| Balance of additive system | 1.50 | 8.71 | 8.71 | 8.71 | 8.71 | 8.71 | 1.50 |
| Zinc dialkyldithiophosphate | — | 0.29 | 0.06 | 0.06 | 0.06 | 0.06 | — |
| Phenolic antioxidant 1 | 1.00 | 1.00 | — | — | — | — | — |
| Phenolic antioxidant 2 | — | — | — | 1.00 | — | 0.50 | — |
| Sulfur-containing phenolic antioxidant | — | — | — | — | 1.00 | — | 1.00 |
| Zinc dialkyldithiocarbamate | — | — | 0.50 | 0.50 | 0.50 | 0.50 | — |
| Ashless dihydrocarbylthiocarbamoyl | — | — | 1.00 | — | — | 0.50 | — |
| Kinematic Viscosity, cSt measured KV @ 100° C. | 13.25 | 13.14 | 13.14 | 13.11 | 13.11 | 13.32 | 13.31 |
| Nitration Screener Test | | | | | | | |
| oxidation (relative to Reference Oil 1) | 1.76 | 1.00 | 0.76 | 0.71 | 0.99 | 0.59 | 1.64 |
| nitration (relative to Reference Oil 1) | 1.55 | 1.00 | 0.64 | 0.83 | 0.82 | 0.37 | 1.44 |
| viscosity increase (relative to Reference Oil 1) | 1.70 | 1.00 | −0.13 | 0.76 | 0.26 | 0.19 | 1.29 |

The test results show significantly superior performance for Reference Oil 1 over both Comparative Oils, in control of viscosity increase, oxidation and nitration. In turn, the invention, as represented by the non-limiting Example Oils 1–4, demonstrated significantly superior performance to that of Reference Oil 1. Again, the invention's superiority was demonstrated in excellent control of viscosity increase, oxidation and nitration. The small negative normalised viscosity increase value for the Example 1 oil simply reflects that there was no significant change in viscosity, unlike the Comparative and Reference oils.

What is claimed is:

1. A lubricating oil composition having extended life as evidenced by reduction in viscosity increase, oxidation and nitration when used in gas engine comprising:

(a) a major amount of a base oil of lubricating viscosity;

(b) a combination of neutral and overbased metallic detergents in an amount sufficient to provide a sulphated ash in the range of about 0.2 wt % to about 2.0 wt %;

(c) based on the volume of the composition from about 0.06 vol % to 0.15 vol % of a zinc dialkyldithiophosphate and about 0.1 vol % to 2.0 vol % of a zinc dialkyldithiocarbamate; and (d) based on the volume of the composition from about 0.5 vol % to about 2.0 vol % of an ashless dihydrocarbylthiocarbamoyl antioxidant.

2. The composition of claim 1 wherein the dihydrocarbylthiocarbamoyl antioxidant is represented by the formula

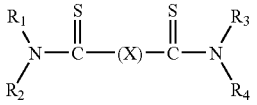

where $R_1$, $R_2$, $R_3$ and $R_4$ are the same or different and each represents an alkyl group of 3 to 30 carbon atoms, X represents S, S—S, S—$(CH_2)_y$S, S—$CH_2CH_2(CH_3)$—S and y is an integer of 1 to 3.

3. The composition of claim 1 or 2 having a phosphorus content of up to 0.008 wt %.

4. The composition of claim 3 wherein the base oil has a viscosity at 100° C. of between about 5 to about 16 cSt.

5. The composition of claim 4 including one or more gas engine oil additives selected from the group consisting of ashless dispersants, ashless antiwear additives, metal passivators, pour point depressants, Viscosity Index improvers and antifoamants.

6. The composition of claim 1 further comprising a phenolic antioxidant in an amount based on the volume of the composition from about 0.5 vol % to about 1.9 vol %.

7. The composition of claim 1 further comprising a mixture of phenolic antioxidants and the ashless dihydrocarbylthiocarbamoyl, wherein the mixture is from about 0.5 vol % to 3.0 vol % based on the volume of the composition.

8. A method for enhancing the life of a lubricating oil composition as evidenced by a reduction in viscosity increase, oxidation and nitration when used in a stationary gas engine by adding to the oil a minor amount of additives comprising (a) a combination of neutral and overbased metallic detergents in an amount sufficient to provide a sulphated ash in the range of about 0.2 wt % to about 2.0 wt % based on the total weight of the composition;

(b) based on the volume of the composition, from about 0.06 vol % to 0.15 vol % of a zinc dialkyldithio phosphate and about 0.1 vol % to 2.0 vol % of a zinc dialkyldithiocarbamate; and (c) based on the volume of the composition, from about 0.5 vol % to about 2.0 vol % of an ashless dihydrocarbylthiocarbamoyl antioxidant.

9. The method of claim 8 wherein the dihydrocarbylthiocarbamoyl antioxidant is represented by the formula

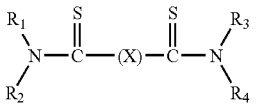

where $R_1$, $R_2$, $R_3$ and $R_4$ are the same or different and each represents an alkyl group of 3 to 30 carbon atoms, X represents S, S—S, S—$(CH_2)_y$—S, S—$CH_2CH_2(CH_3)$—S and y is an integer of 1 to 3.

10. The method of claim 9 wherein the lubricating oil has a phosphorus content of up to 0.008 wt %.

11. The method of claim 10 wherein the base oil has a viscosity of about 5 to about 16 cSt at 100° C.

12. The method of claim 11 wherein the lubricating oil includes one or more gas engine oil additives selected from the group consisting of ashless dispersants, ashless antiwear additives, metal passivators, pour point depressants, Viscosity Index improvers and antifoamants.

13. The method of claim 8 further comprising a phenolic antioxidant in an amount based on the volume of the composition from about 0.5 vol % to about 1.9 vol %.

14. The method of claim 8 further comprising a mixture of phenolic antioxidants and the ashless dihydrocarbylthiocarbamoyl, wherein the mixture is from about 0.5 vol % to 3.0 vol % based on the volume of the composition.

* * * * *